US010529309B1

(12) United States Patent
Phillips

(10) Patent No.: US 10,529,309 B1
(45) Date of Patent: Jan. 7, 2020

(54) HARMONICA HOLDER

(71) Applicant: Roscoe Phillips, Montgomery, AL (US)

(72) Inventor: Roscoe Phillips, Montgomery, AL (US)

( * ) Notice: Subject to any disclaimer, the term of this patent is extended or adjusted under 35 U.S.C. 154(b) by 0 days.

(21) Appl. No.: 16/170,546

(22) Filed: Oct. 25, 2018

(51) Int. Cl.
*G10G 5/00* (2006.01)
*G10K 11/08* (2006.01)

(52) U.S. Cl.
CPC ..... *G10G 5/005* (2013.01); *G10K 11/08* (2013.01)

(58) Field of Classification Search
CPC ..... G10G 5/005; G10K 11/08
See application file for complete search history.

(56) References Cited

U.S. PATENT DOCUMENTS 1,741,835 A * 12/1929 Gantner ..... G10D 9/00 84/400
4,091,703 A 5/1978 Adamitis
8,362,346 B1 1/2013 Prozinski
2006/0225557 A1* 10/2006 Berschneider ..... G10D 7/123 84/379

* cited by examiner

*Primary Examiner* — Kimberly R Lockett
(74) *Attorney, Agent, or Firm* — Sanchelima & Associates, P.A.; Chrisitian Sanchelima; Jesus Sanchelima

(57) ABSTRACT

The present invention envisages a harmonica holder for releaseably holding and amplifying the sound of the harmonica. The harmonica holder comprises a holder portion for releasably holding a harmonica, wherein the holder portion includes a pair of holder plates having a means to selectively hold and release the harmonica; and a horn portion extending from the holder portion, wherein one end of the horn portion is connected to the holder portion such that the sound emitted from the harmonica travels thru the horn portion, thereby getting amplified, the horn portion having a bell-like configuration and airholes configured thereon.

4 Claims, 6 Drawing Sheets

HARMONICA HOLDER

BACKGROUND OF THE INVENTION

1. Field of the Invention

The present disclosure relates to a holder for a harmonica, which can amplify the sound of the harmonica as well as provided a special effect to the sound emitted by the harmonica.

2. Description of the Related Art

Harmonica holders are devices that allow holding a harmonica near a microphone while a performer is putting on a performance. However, providing amplification as well as special effects to the sound emitted by the harmonica in a natural manner is desired, before it is amplified electrically by the microphone.

Several designs for harmonica holders or harmonica amplifiers have been designed in the past. None of them, however, are known to provide amplification and special effects to the sound emitted by the harmonica is a natural manner.

Applicant believes that a related reference corresponds to U.S. Pat. No. 4,091,703 filed by JOHN P. ADAMITIS. The Adamitis reference discloses a harmonica horn that provides an echo effect to the sound emitted by a particular reed of the harmonica. However, it is difficult to operate the harmonica horn as it involves skilfully sliding the horn along the length of the harmonica. Furthermore, the horn only amplifies the sound emitted by a certain reed, and not by the entire harmonica.

Another related application is U.S. Pat. No. 8,362,346 filed by DAN EDWARD PROZINSKI. The Prozinski reference discloses a holder for a performer to play the harmonica while simultaneously playing other instruments. However, the bicycle disclosed in the Prozinski reference fails to disclose any means for providing special effects to the sound emitted by the harmonica.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a harmonica holder for naturally amplifying the sound emitted by the harmonica.

It is yet another object of the present invention to provide a harmonica holder for providing a special effect to the sound emitted by the harmonica, as if the harmonica is being played inside of a well or a cave.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
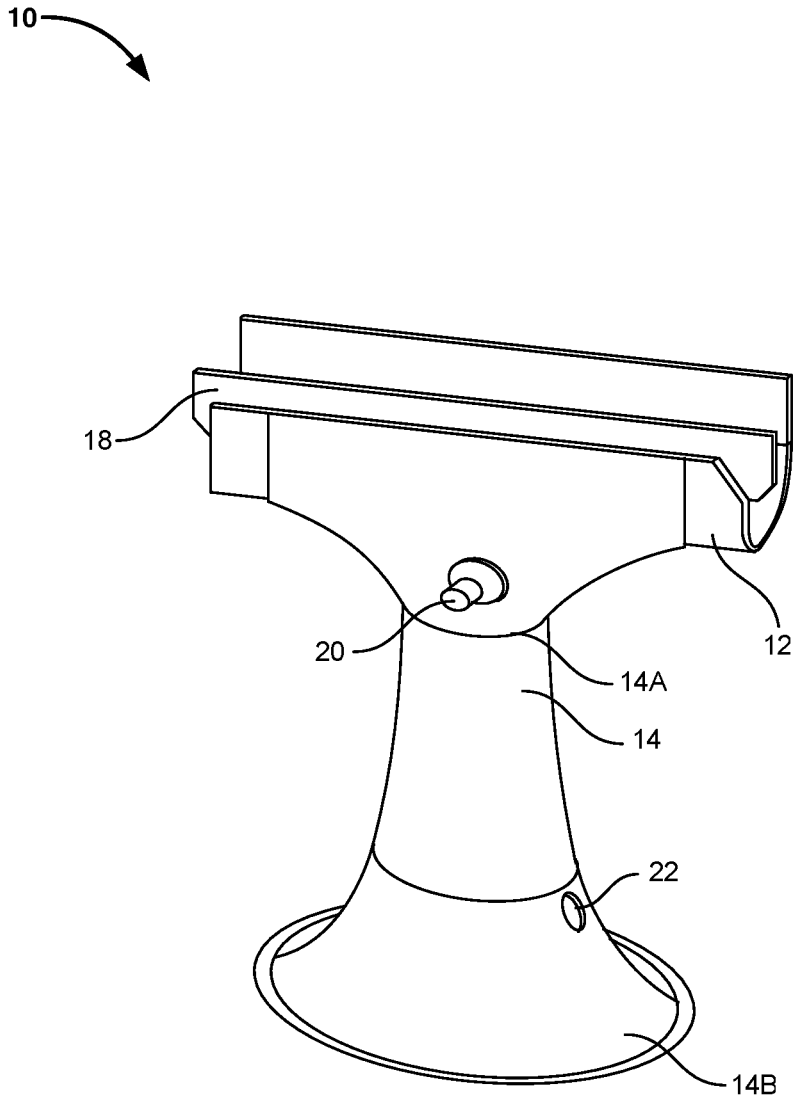
FIG. 1 illustrates an isometric view of a harmonica holder 10, in accordance with an embodiment of the present invention, wherein the harmonica holder 10 comprises a holder portion 12 and a horn portion 14 extending from the holder portion 12.
Figure 2:
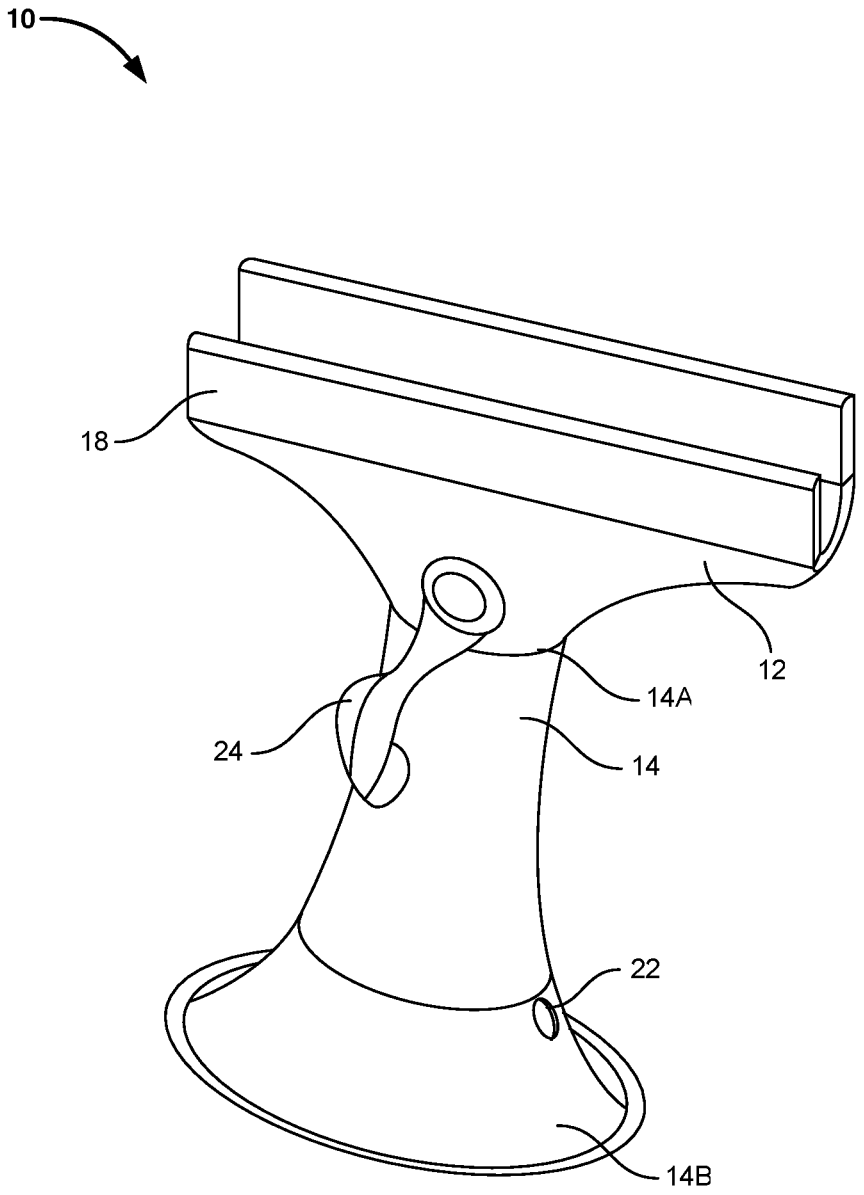
FIG. 2 illustrates another isometric view of the harmonica holder 10, in accordance with an embodiment of the present invention, which includes a handle 24.
Figure 3:
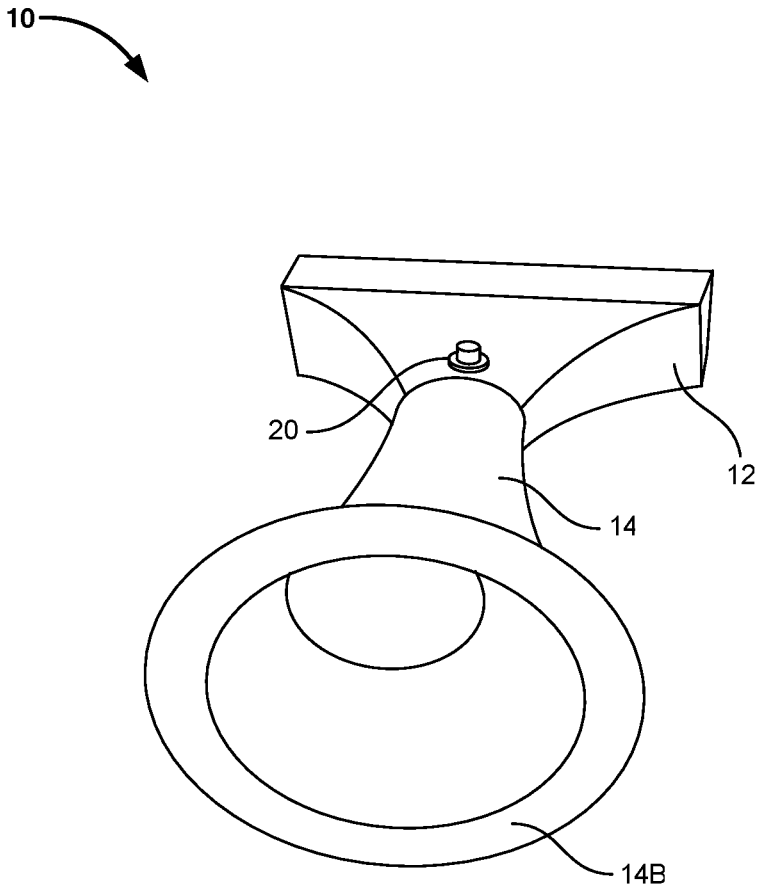
FIG. 3 illustrates another isometric view of the harmonica holder 10, in accordance with an embodiment of the present invention.
Figure 4:
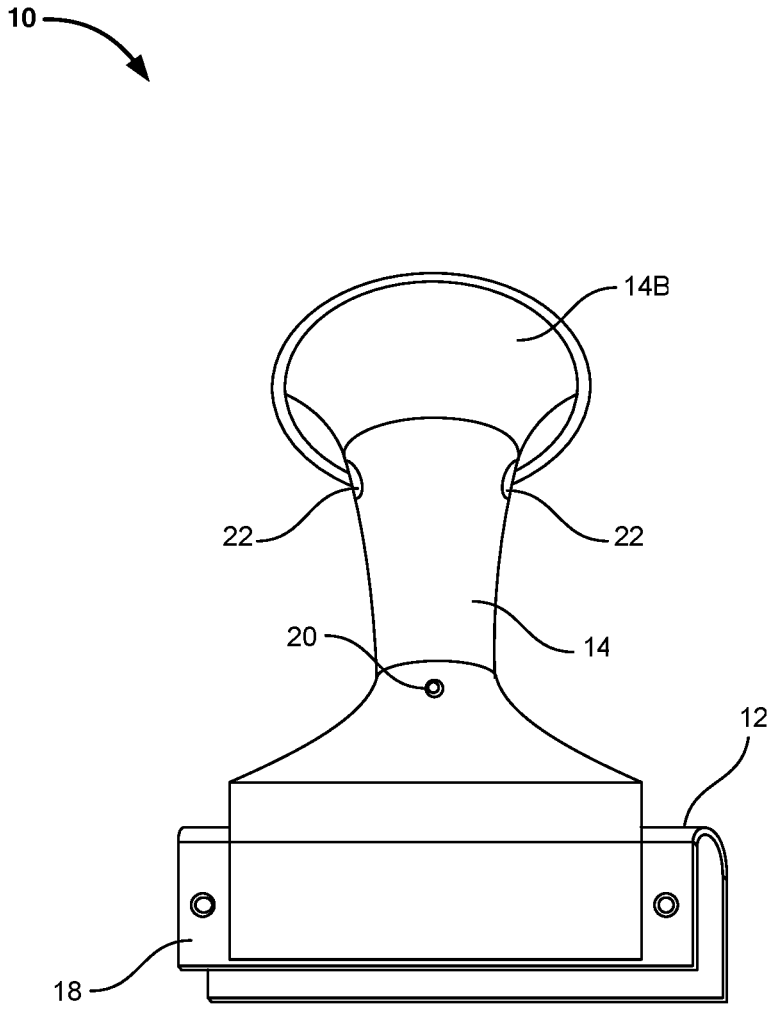
FIG. 4 illustrates another front view of the harmonica holder 10, in accordance with an embodiment of the present invention.
Figure 5:
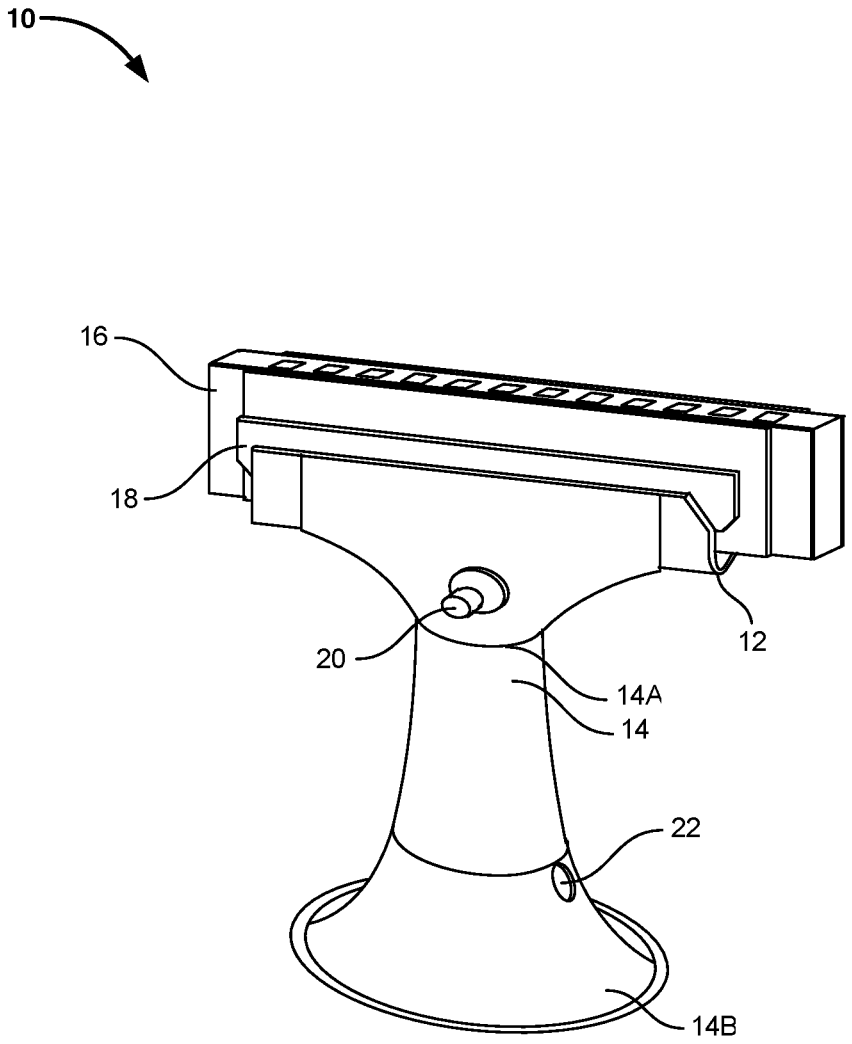
FIG. 5 illustrates another isometric view of the harmonica holder 10, in accordance with an embodiment of the present invention, in which the harmonica 16 is mounted.
Figure 6:
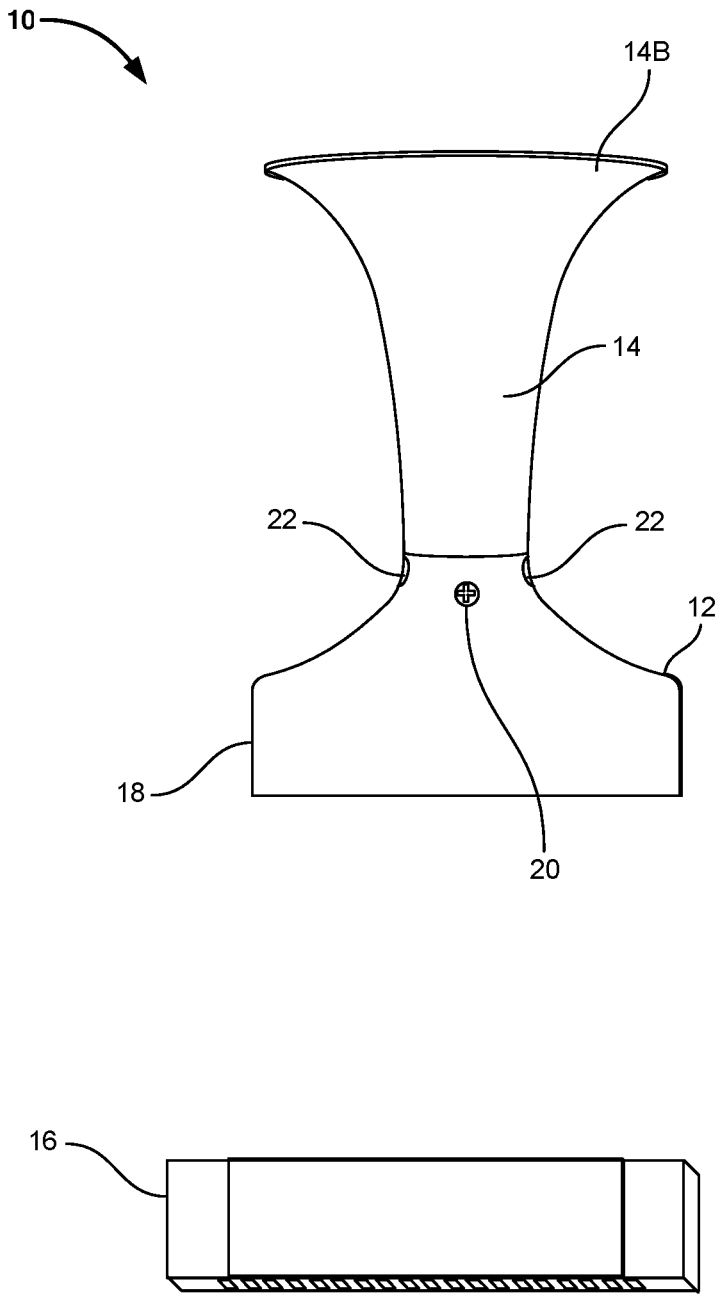
FIG. 6 illustrates another an exploded view of the harmonica holder 10, in accordance with an embodiment of the present invention, wherein the airholes 22 are provided at the holder portion 12 of the harmonica holder 10.

Referring now to FIGS. 1-6, where the present invention is generally referred to with numeral 10, it can be observed that a harmonica holder 10 (also referred to holder 10 hereinafter) comprises holder portion 12 for releasably holding a harmonica, and a horn portion 14 extending from the holder portion 12.

The holder 10 is a device that allows mounting of a harmonica 16 thereon. The holder 10 includes the horn portion 14. The horn portion 14 is has a first end 14A and a second end 14B. The first end 14A of the horn portion 14 is connected to the holder portion 12. More specifically, the connection of the horn portion 14 with the holder portion 12 is such that the sound of the harmonica 16 directly enters the horn portion 14, thereby getting amplified due to the bell-like configuration of the horn portion 14.

The connection of the horn portion 14 to the holder portion 12 can be termed as fluid communication because what is entering the horn portion 14 is the sound of the harmonica 16, which is nothing but sound waves travelling thru a fluid medium, i.e., air. As such, the horn portion 14 is connected to the holder portion 12 in a manner that there is fluid communication between the two portions.

The harmonica 16 is mounted to the holder portion 12 such that a longitudinal axis of a reed of the harmonica 16 or the longitudinal axes of all the reeds of the harmonica 16 are parallel to a longitudinal axis of the holder 10. More specifically, the axis of the shorter edge of the harmonica 16 is parallel to the longitudinal axis of the holder 10.

The holder portion 14 of the holder 10 comprises a pair of holder plates 18. The pair of holder plates 18, in accordance with the present invention, is a single plate bent to have a U-shaped configuration, wherein the plate extending from the base of the U-shaped configuration are considered to be a pair.

The distance or space between the pair of plates 18 is defined by the dimensions of the base of the U-shaped configuration. In one embodiment, the base is made wide enough to accommodate harmonicas of different sizes.

To snugly fit the harmonica 16 between the plates 18, means to selectively hold and release the harmonica 16 in between the plates 18 are provided on the plates 18. In accordance with an embodiment of the present invention, this means is a nut and bolt arrangement 20. More specifically, the bolt is loosened before the harmonica 16 is placed in between the plates 18. When the bolt is loosened, sufficient space is available between the plates 18 for accommodating the harmonica 16 therewithin. After the harmonica 16 is placed within this space, the nut and bolt arrangement 20 is tightened again for securing the harmonica in between the plates 18.

The horn portion 14 or the holder portion 12 of the holder 10 can be provided with airholes 22. The airholes 22 facilitate in giving an echo-effect to the incoming sound. In accordance with one embodiment of the present invention illustrated in FIG. 6, the holder portion 12 is provided with a pair of airholes 22 adjacent the location where the horn portion 12 and the holder portion 14 are connected. In another embodiment, the number of airholes 22 can any number greater or less than two, as per the application requirements.

The holder 10, in accordance with an embodiment of the present invention, also comprises a handle 24. The handle 24 can be a piece of fabric attached to the holder 10 for allowing the holder 10 to be easily carried.

The application of the holder 10 is that it can be used to naturally amplify the sound emitted from the harmonica prior to being electrically amplified by the microphone. More specifically, the holder 10 is mounted to the microphone such that the horn portion 14 of the holder 10 is just in front of the microphone while the performer is putting on a performance. The advantage of the holder 10 is that it gives a special effect to the sound being emitted from the harmonica 16 that it is being played in an enclosed space such as a well or a cave.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A harmonica holder for releasably holding and amplifying the sound of a harmonica, said harmonica holder comprising:

a. a holder portion for releasably holding said harmonica, wherein said holder portion is a plate bent to have a U-shaped configuration;

b. a horn portion extending from said holder portion, wherein one end of said horn portion is connected to the holder portion such that the sound emitted from the harmonica travels thru the horn portion, thereby being amplified;

c. a handle mounted to said holder portion adapted to permit a user to carry and transport said harmonica holder;

d. a pair of airholes configured to create an echo effect to any incoming sound, said pair of airholes located on said holder portion at a location adjacent to where said holder portion and said horn portion connect;

e. said holder portion has a floor and a first and second side wall defining said U-shape, a first holder plate mounted parallel to said first side wall, said first side wall has a length substantially similar to said first holder plate length, a second holder plate mounted parallel to said second side wall, said second side wall has a length substantially similar to said second holder plate length, said harmonica is held in place by said first holder plate and said second holder plate;

f. said holder portion having a first and second exterior surface that each include a first opening in line with a second opening, respectively; and g. a bolt having a distal end is inserted into said first opening and passed under said harmonica and passed through said second opening until the distal end of said bolt is protruding out of said second opening, a nut is screwed into the protruding distal end of said bolt so that said first and second holder plates are urged together thereby locking said harmonica therebetween.

2. The harmonica holder of claim 1, wherein the harmonica is mounted to the holder portion such that a longitudinal axis of each reed of the harmonica is parallel to a longitudinal axis of the harmonica holder.

3. The harmonica holder of claim 1, wherein the horn portion has a bell-like configuration.

4. The harmonica holder of claim 3, wherein the horn portion, with the bell-like configuration, have at least one airhole provided thereon.

* * * * *